US010492287B2

(12) United States Patent
Jiang et al.

(10) Patent No.: US 10,492,287 B2
(45) Date of Patent: Nov. 26, 2019

(54) APPARATUS AND METHOD FOR ISOTOPE PRODUCTION BASED ON A CHARGED PARTICLE ACCELERATOR

(71) Applicants: Omega-P R&D, Inc., New Haven, CT (US); YALE UNIVERSITY, New Haven, CT (US)

(72) Inventors: Yong Jiang, New Haven, CT (US); Jay L. Hirshfield, Orange, CT (US)

(73) Assignees: OMEGA-P R&D, INC., New Haven, CT (US); YALE UNIVERSITY, New Haven, CT (US)

( * ) Notice: Subject to any disclaimer, the term of this patent is extended or adjusted under 35 U.S.C. 154(b) by 0 days.

(21) Appl. No.: 16/123,708

(22) Filed: Sep. 6, 2018

(65) Prior Publication Data

US 2019/0075645 A1 Mar. 7, 2019

Related U.S. Application Data

(60) Provisional application No. 62/554,786, filed on Sep. 6, 2017.

(51) Int. Cl.

| | |
|---|---|
| ***H05H 7/00*** | (2006.01) |
| ***H05H 7/04*** | (2006.01) |
| ***H05H 7/08*** | (2006.01) |
| ***H05H 7/18*** | (2006.01) |
| ***H05H 13/00*** | (2006.01) |
| ***H05H 7/10*** | (2006.01) |

(52) U.S. Cl.

CPC ..... *H05H 7/001* (2013.01); *H05H 7/04* (2013.01); *H05H 7/08* (2013.01); *H05H 7/10* (2013.01); *H05H 7/18* (2013.01); *H05H 13/005* (2013.01); *H05H 2007/007* (2013.01)

(58) Field of Classification Search

USPC ..... 250/396 R, 492.3

See application file for complete search history.

(56) References Cited

U.S. PATENT DOCUMENTS 4,906,900 A * 3/1990 Asmussen ..... C30B 23/02 118/50.1

5,361,016 A * 11/1994 Ohkawa ..... H01J 37/32192 313/231.31

* cited by examiner

*Primary Examiner* — Kiet T Nguyen

(74) *Attorney, Agent, or Firm* — Arent Fox LLP

(57) ABSTRACT

Apparatuses and methods for accelerating charged particles including a charged particle source configured to provide charged particles, an accelerator including: a cavity having one or more inlets and one or more outlets, an electromagnet substantially surrounding at least a portion of the cavity, a conductor disposed longitudinally within the cavity configured to accelerate the charged particles entering the cavity through the one or more inlets via a radio frequency wave applied to the cavity, wherein the radio frequency wave operates in transverse electromagnetic mode, and a target configured to receive the accelerated charged particles via the one or more outlets.

20 Claims, 10 Drawing Sheets
(1 of 10 Drawing Sheet(s) Filed in Color)

900

| | |
|---|---|
| PET Isotopes | $^{10}B(d, n)^{11}C$, $^{12}C(d, n)^{13}N$ , $^{20}Ne(d, \alpha)^{18}F$ |
| SPECT Isotopes | $^{66}Zn(d, n)^{67}Ga$, $^{122}Te(d, n)^{123}I$, $^{98}Mo(d, n)^{99m}Tc$ |
| Theranostic Isotopes | $^{47}Ti$ (d, n+α) $^{44}Sc$, $^{47}Ti$ (n, p) $^{47}Sc$, $^{186}W(d, 2n)^{186}Re$ |
| Neutron Source | $^{7}Li(d, n)^{8}Be$, $^{9}Be(d, n)^{10}B$, $^{12}C(d, n)^{13}N$ |
| Neutrino Source | $^{7}Li(d, p)^{8}Li$ |

*FIG. 9*

APPARATUS AND METHOD FOR ISOTOPE PRODUCTION BASED ON A CHARGED PARTICLE ACCELERATOR

CROSS REFERENCE TO RELATED APPLICATION

The present application is related to and claims priority to U.S. Provisional Patent Application No. 62/554,786 entitled "Apparatus and Method for Isotope Production Based on a Deuteron Accelerator," filed on Sep. 6, 2017, the entire contents of which are incorporated by reference in its entirety.

TECHNICAL FIELD

Aspects of the present disclosure generally relate to apparatuses and methods for accelerating ions, protons, electrons, and/or other charged particles.

BACKGROUND

Energetic charged particles have many usage applications in the fields of medicine, nuclear energy, testing, experimental research, national security, etc. Examples of energetic charged particles include ions, protons, electrons, and positrons. Conventional equipment used in producing energetic charged particles may require high investment cost and large facilities or real estate, while limiting the mobility of the equipment. Therefore, there continue to be unmet needs for improvements in the production of energetic charged particles.

SUMMARY

This summary is provided to introduce a selection of concepts in a simplified form that are further described below in the DETAILED DESCRIPTION. This summary is not intended to identify key features of the claimed subject matter, nor is it intended to be used as an aid in determining the scope of the claimed subject matter.

Aspects of the present disclosure include apparatuses for accelerating charged particles, including a charged particle source configured to provide charged particles, an accelerator including: a cavity having one or more inlets and one or more outlets, an electro-magnet substantially surrounding at least a portion of the cavity, a conductor disposed longitudinally within the cavity, the conductor being configured to accelerate the charged particles entering the cavity through the one or more inlets via a radio frequency wave applied to the conductor, wherein the radio frequency wave operates in transverse electromagnetic mode, and a target configured to receive the accelerated charged particles via the one or more outlets.

Another aspect of the present disclosure includes a particle accelerator having a transverse electromagnetic mode (TEM) cavity, a plurality of inlets configured to receive one or more streams of charged particles into the TEM cavity, a superconducting electro-magnet encapsulating at least a portion of the TEM cavity, wherein the electro-magnet is configured to perform at least one of maintaining a cyclotron resonance condition or preventing the one or more streams of charged particles from contacting an inner wall of the TEM cavity, and a rod-shape conductor disposed longitudinally within the TEM cavity configured to accelerate the one or more streams of charged particles into one or more streams of accelerated charged particles by applying electromagnetic radiations in TEM mode.

Other aspects of the present disclosure include other methods, apparatuses, and computer readable media for use in accordance with accelerating charged particles that may include performing the steps of receiving a plurality of charged particles via one or more inlets, applying a radio frequency wave in transverse electromagnetic mode to accelerate the plurality of charged particles using an elongated conductor disposed longitudinally along substantially a center of the cavity, and emitting the plurality of accelerated charged particles via one or more outlets.

Additional advantages and novel features of these aspects will be set forth in part in the description that follows, and in part will become more apparent to those skilled in the art upon examination of the following or upon learning by practice of the disclosure.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The features of various aspects of the disclosure are set forth in the appended claims. In the description that follows, like parts are marked throughout the specification and drawings with the same or similar numerals, respectively. The drawing figures are not necessarily drawn to scale, and certain figures may be shown in exaggerated or generalized form in the interest of clarity and/or conciseness. The disclosure itself, however, as well as a preferred mode of use, further advantages thereof, will be best understood by reference to the following detailed description of illustrative aspects of the disclosure when read in conjunction with the accompanying drawings, wherein:

FIG. 9 illustrates an example of a table of source particles and the corresponding product particles that may be generated using methods and systems in accordance with aspects of the present disclosure.

DETAILED DESCRIPTION

The following includes definitions of selected terms employed herein. The definitions include various examples and/or forms of components that fall within the scope of a term and that may be used for implementation. The examples are not intended to be limiting.

A "processor," as used herein, processes signals and performs general computing and arithmetic functions. Signals processed by the processor may include digital signals, data signals, computer instructions, processor instructions, messages, a bit, a bit stream, or other computing that may be received, transmitted and/or detected.

A "memory," as used herein may include volatile memory and/or non-volatile memory. Non-volatile memory may include, for example, ROM (read only memory), PROM (programmable read only memory), EPROM (erasable PROM) and EEPROM (electrically erasable PROM). Volatile memory may include, for example, RAM (random access memory), synchronous RAM (SRAM), dynamic RAM (DRAM), synchronous DRAM (SDRAM), double data rate SDRAM (DDR SDRAM), and/or direct RAM bus RAM (DRRAM).

An "operable connection," as used herein may include a connection by which entities are "operably connected", is one in which signals, physical communications, and/or logical communications may be sent and/or received. An operable connection may include a physical interface, a data interface and/or an electrical interface.

High intensity neutron sources may have broad applications in fundamental research, isotope production, medical therapy, material analysis and imaging. Particularly with great scientific impact, low-energy precision experiments using neutrons and decay nuclei may provide critical tests of the Standard Model. Neutron sources have become a desirable tool in discovering the violation of fundamental symmetry in electronic dipole moments, for example.

Aspects of the present disclosure may include an accelerator operating in TEM mode. The accelerator may include a conductor in the TEM cavity that delivers a continuous or pulsed wave to accelerate charged particles injected into the cavity. The TEM cavity may be sufficiently compact to fit into a commercial medical magnetic resonant imaging (MRI) magnet and operated using a RF power source delivering sufficient power to accelerate the charged particles to desired particles energy and power, for example. The accelerator may include a magnet that maintains a cyclotron resonance condition inside the cavity. The cyclotron resonance condition, as known to one skilled in the art, may cause charged particles to gyrate in a substantially circular or elliptical path and accelerate under a continuous or pulsed oscillating electric field tuned to the resonance. The electric field may add kinetic energy to the charged particles.

Figure 1:
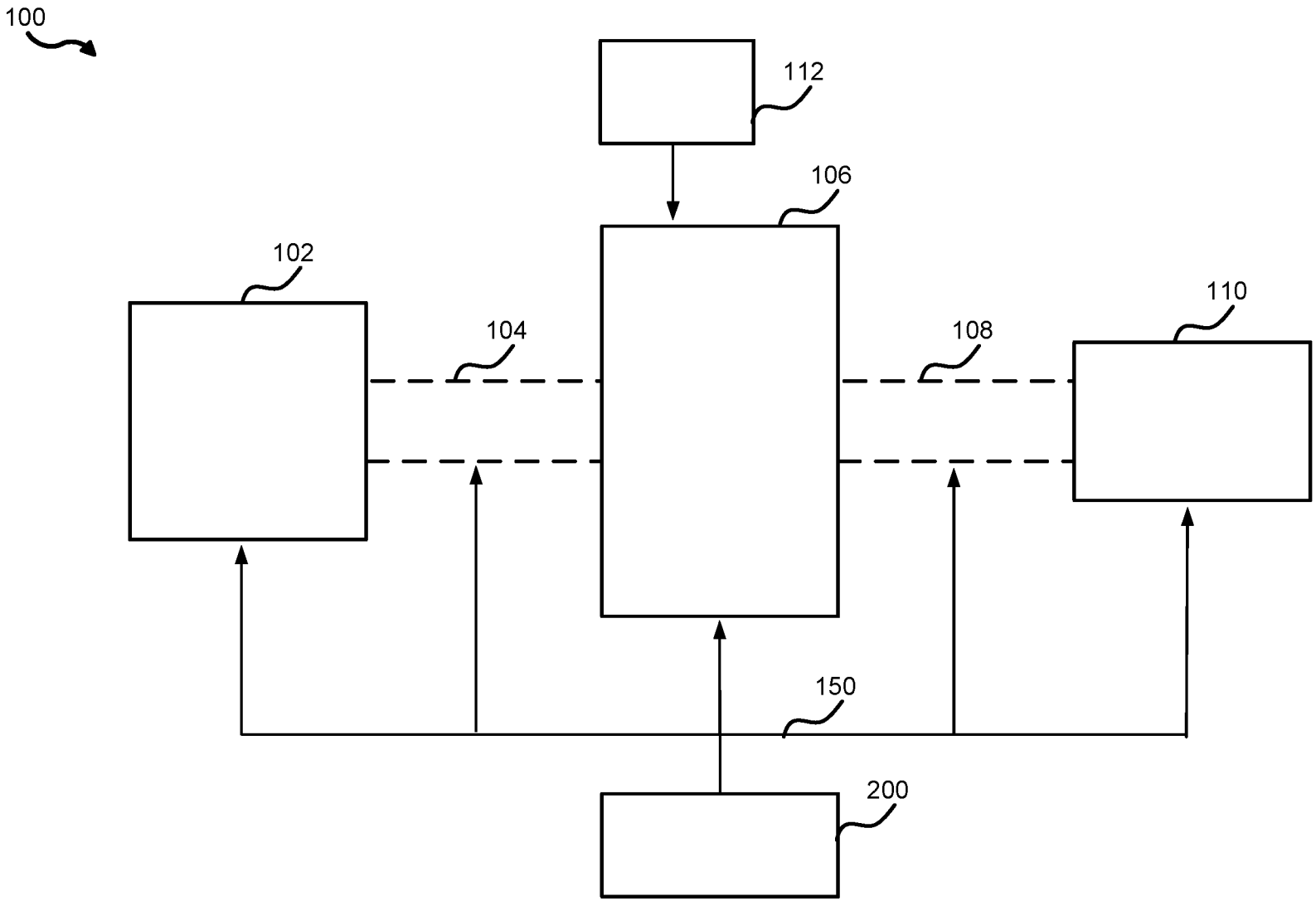
FIG. 1 illustrates a schematic view of an example system of a charged particles accelerator, for use in accordance with aspects of the present disclosure.

Turning to FIG. 1, in some implementations, a schematic view of a non-limiting example of a cyclotron auto-resonance system 100 for accelerating charged particles may include a charged particles source 102, various features of which may be usable in accordance with aspects of the present disclosure. The charged particles source 102 may provide charged particles using electron ionization, electron capture ionization, chemical ionization, charge exchange ionization, chemi-ionization, associative ionization, Penning ionization, ion attachment, inductively coupled plasma ionization, micro-wave plasma ionization, electron-cyclotron resonance ionization, glow discharge ionization, plasma afterglow ionization, spark ionization, and/or photoionization as known in the art.

In some examples, the charged particles source 102 may emit one or more charged particles, such as deuterons, protons, electrons, ions, and/or other particles carrying positive or negative electrical charges. The charged particles may be emitted by the charge particles source 102 into an optional low energy beam transport (LEBT) 104. The optional LEBT 104 may receive the charged particles from the charged particles source 102 and generate one or more beams of charged particles having energy levels of 10 kilo electron-volt (keV), 20 keV, 30 keV, 50 keV, 80 keV, 100 keV, 200 keV, 500 keV, or 1 MeV. Other energy levels are possible.

In certain implementations, the cyclotron auto-resonance system 100 may include an accelerator 106. The accelerator 106 may receive the one or more beams of charged particles from the LEBT 104 (optional). In certain examples, the optional LEBT 104 may guide the one or more beams of charged particles from the charged particles source 102 into the accelerator 106. The accelerator 106 may apply a radio frequency (RF) electro-magnetic wave (e.g., microwave) in TEM mode within the accelerator 106. The applied RF wave may accelerate the charged particles by inputting electromagnetic energy into the charged particles. The one or more beams of charged particles may accelerate to energy levels (e.g., average) of 10 keV, 20 keV, 50 keV, 100 keV, 200 keV, 500 keV, 1 mega electron-volt (MeV), 2 MeV, 3 MeV, 5 MeV, 8 MeV, 10 MeV, 12 MeV, 15 MeV, 20 MeV, 30 MeV, 50 MeV, 100 MeV, 200 MeV, and/or 500 MeV. Other energy levels are possible.

In a non-limiting example, the cyclotron auto-resonance system 100 may include an optional medium energy beam transport (MEBT) 108. The optional MEBT 108 may guide the accelerated one or more beams of charged particles exiting the accelerator 106 into a target 110. In some implementations, the optional MEBT 108 may focus the accelerated one or more beams of charged particles into a concentrated area on the target 110. In other implementations, the optional MEBT 108 may guide the accelerated one or more beams of charged particles into more than areas on the target 110. The target 110 may include a high density supersonic helium jet gas target, a liquid/solid lithium target, a solid target, a cylindrical or spherical target, a copper target, a scandium target, and/or a rhenium target. As discussed further below, the target 110 may be selected by one skilled in the art, for example, depending on the desired application, including nuclear physics, medical imaging, national security, etc.

In some examples, the cyclotron auto-resonance system 100 may include a RF power source 112 that provides electrical power to the accelerator 106. The RF power source 112 may provide a continuous or pulsed wave operating at 10 megahertz (MHz), 20 MHz, 30 MHz, 50 MHz, 70 MHz, 100 MHz, 150 MHz, 200 MHz, or 500 MHz. The RF power source 112 may be able to supply 10 kilowatt (kW), 20 kW, 30 kW, 50 kW, 70 kW, 100 kW, 200 kW, 500 kW of electrical power. In some implementations, the frequency of the wave may be matched to the cyclotron resonant frequency (described below).

Still referring to FIG. 1, the cyclotron auto-resonance system 100 may include a computer system 200 configured to automatically control the generation of accelerated charged particles and/or various other features of the system 100, such as those used for one or more accelerated beams of charge particles, via communication couplings 150. The communication links 150 may be wired and/or wireless couplings, including Wireless Fidelity (WiFi) links, Bluetooth links, General Purpose Interface Bus (GPIB) links, Parallel links, Serial links, Universal Serial Bus (USB) links, Peripheral Component Interconnect (PCI) link, or other suitable communication couplings.

Figure 2:
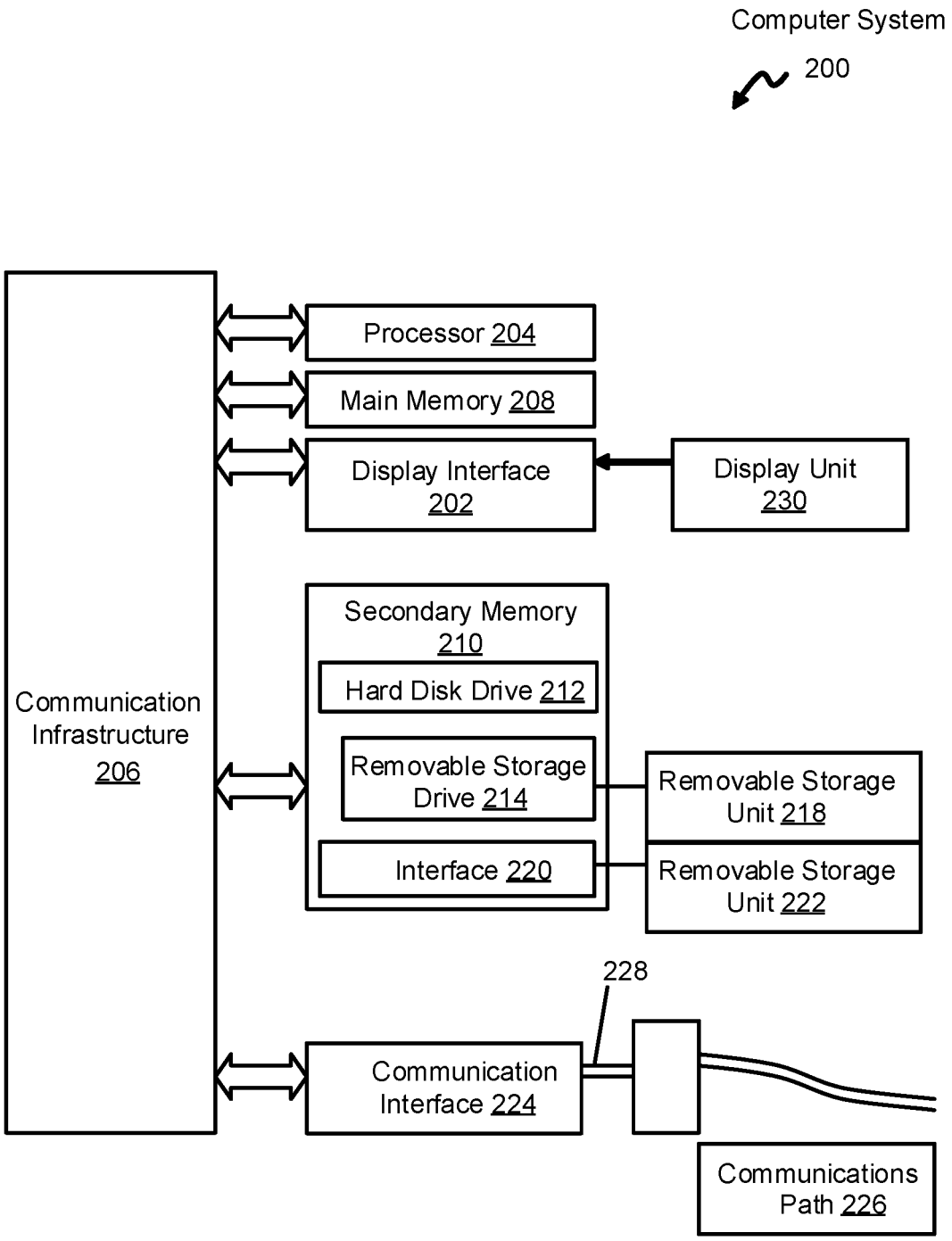
FIG. 2 illustrates an example of a computer system for implementing a method of exchanging products in accordance with aspects of the present disclosure.

In an aspect of the present disclosure, features are directed toward one or more computer systems capable of carrying out the functionality described herein. An example of such the computer system 200 is shown in FIG. 2. The computer system 200 may include one or more processors, such as the processor 204. The processor 204 is connected to a communication infrastructure 206 (e.g., a communications bus, cross-over bar, or network). Various software aspects are described in terms of this example computer system. After reading this description, it will become apparent to a person skilled in the relevant art(s) how to implement aspects of the disclosure using other computer systems and/or architectures.

The computer system 200 may include a display interface 202 that forwards graphics, text, and other data from the communication infrastructure 206 (or from a frame buffer not shown) for display on a display unit 230. Computer system 200 also includes a main memory 208, preferably random access memory (RAM), and may also include a secondary memory 210. The secondary memory 210 may include, for example, a hard disk drive 212, and/or a removable storage drive 214, representing a floppy disk drive, a magnetic tape drive, an optical disk drive, a universal serial bus (USB) flash drive, etc. The removable storage drive 214 reads from and/or writes to a removable storage unit 218 in a well-known manner. Removable storage unit 218 represents a floppy disk, magnetic tape, optical disk, USB flash drive etc., which is read by and written to removable storage drive 214. As will be appreciated, the removable storage unit 218 includes a computer usable storage medium having stored therein computer software and/or data.

Alternative aspects of the present disclosure may include secondary memory 210 and may include other similar devices for allowing computer programs or other instructions to be loaded into computer system 200. Such devices may include, for example, a removable storage unit 222 and an interface 220. Examples of such may include a program cartridge and cartridge interface (such as that found in video game devices), a removable memory chip (such as an erasable programmable read only memory (EPROM), or programmable read only memory (PROM)) and associated socket, and other removable storage units 222 and interfaces 220, which allow software and data to be transferred from the removable storage unit 222 to computer system 200.

Computer system 200 may also include a communications interface 224. Communications interface 224 allows software and data to be transferred between computer system 200 and external devices. Examples of communications interface 224 may include a modem, a network interface (such as an Ethernet card), a communications port, a Personal Computer Memory Card International Association (PCMCIA) slot and card, etc. Software and data transferred via communications interface 224 are in the form of signals 228, which may be electronic, electromagnetic, optical or other signals capable of being received by communications interface 224. These signals 228 are provided to communications interface 224 via a communications path (e.g., channel) 226. This path 226 carries signals 228 and may be implemented using wire or cable, fiber optics, a telephone line, a cellular link, an RF link and/or other communications channels. In this document, the terms "computer program medium" and "computer usable medium" are used to refer generally to media such as a removable storage drive 218, a hard disk installed in hard disk drive 212, and signals 228. These computer program products provide software to the computer system 200. Aspects of the present disclosure are directed to such computer program products.

Computer programs (also referred to as computer control logic) are stored in main memory 208 and/or secondary memory 210. Computer programs may also be received via communications interface 224. Such computer programs, when executed, enable the computer system 200 to perform the features in accordance with aspects of the present disclosure, as discussed herein. In particular, the computer programs, when executed, enable the processor 204 to perform the features in accordance with aspects of the present disclosure. Accordingly, such computer programs represent controllers of the computer system 200.

In an aspect of the present disclosure where the method is implemented using software, the software may be stored in a computer program product and loaded into computer system 200 using removable storage drive 214, hard drive 212, or communications interface 220. The control logic (software), when executed by the processor 204, causes the processor 204 to perform the functions described herein. In another aspect of the present disclosure, the system is implemented primarily in hardware using, for example, hardware components, such as application specific integrated circuits (ASICs). Implementation of the hardware state machine so as to perform the functions described herein will be apparent to persons skilled in the relevant art(s).

Figure 3:
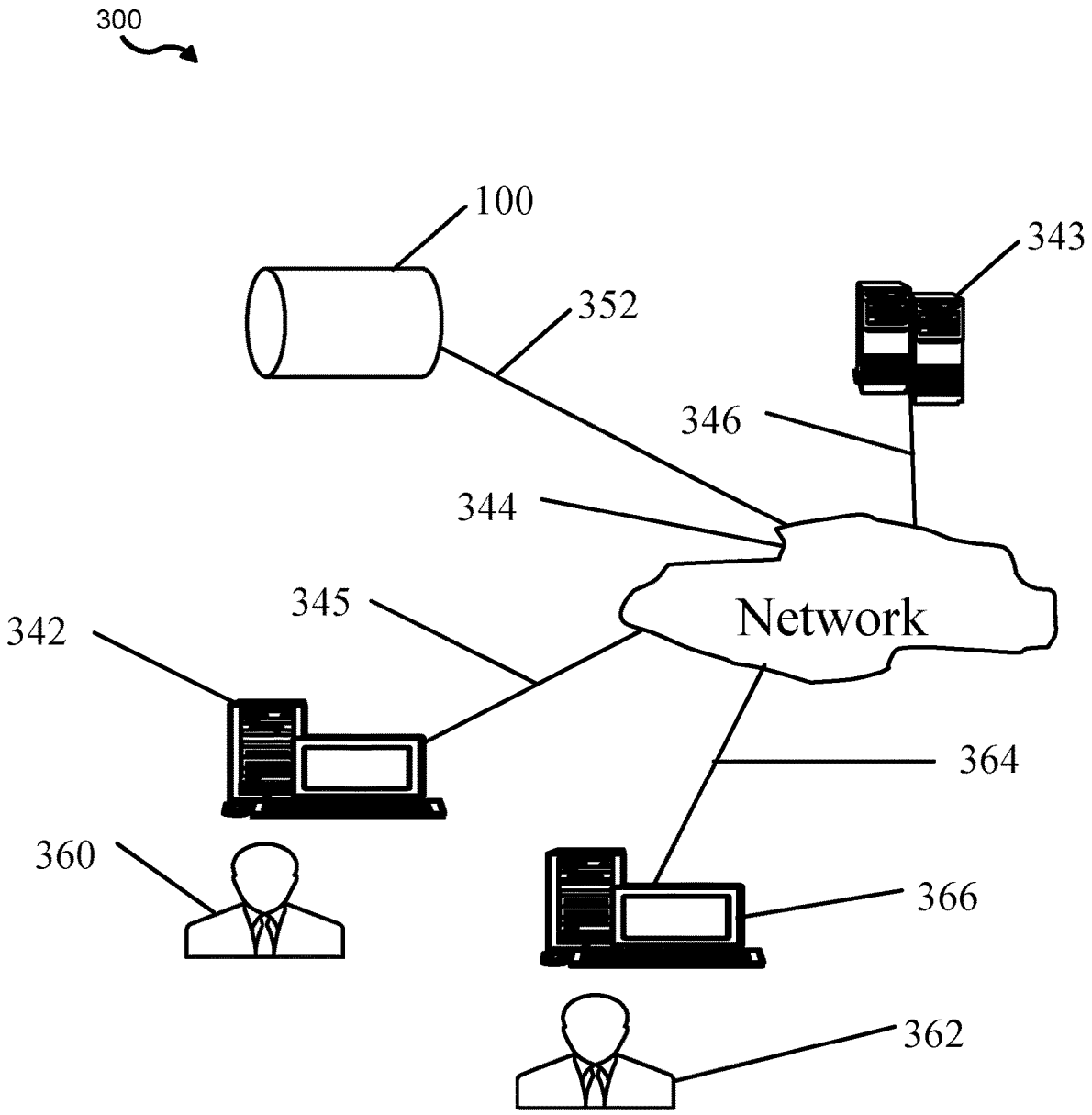
FIG. 3 illustrates a block diagram of various exemplary system components, in accordance with aspects of the present disclosure.

FIG. 3 illustrates a block diagram of various example system components for use with implementations in accordance with an aspect of the present disclosure. FIG. 3 shows a communication system 300 usable in accordance with aspects of the present disclosure. The communication system 300 includes one or more accessors 360, 362 (also referred to interchangeably herein as one or more "users") and one or more terminals 342, 366. In one aspect, data for use in accordance with aspects of the present disclosure may, for example, be input and/or accessed by accessors 360, 362 via terminals 342, 366, such as personal computers (PCs), minicomputers, mainframe computers, microcomputers, telephonic devices, or wireless devices, such as personal digital assistants ("PDAs") or a hand-held wireless devices coupled to a server 343, such as a PC, minicomputer, mainframe computer, microcomputer, or other device having a processor and a repository for data and/or connection to a repository for data, via, for example, a network 344, such as the Internet or an intranet, and couplings 345, 346, 364. The couplings 345, 346, 364 include, for example, wired, wireless, or fiberoptic links. In another example variation, the method and system in accordance with aspects of the present disclosure operate in a stand-alone environment, such as on a single terminal. In some aspects, the cyclotron auto-resonance system 100 may be connected to the network 344 via a coupling 352. The data from the cyclotron auto-resonance system 100 may be accessed via the network 344 by, for example, the terminals 342, 366. The cyclotron auto-resonance system 100 may also access data from, for example, the server 343 via the network 344.

Figure 4:
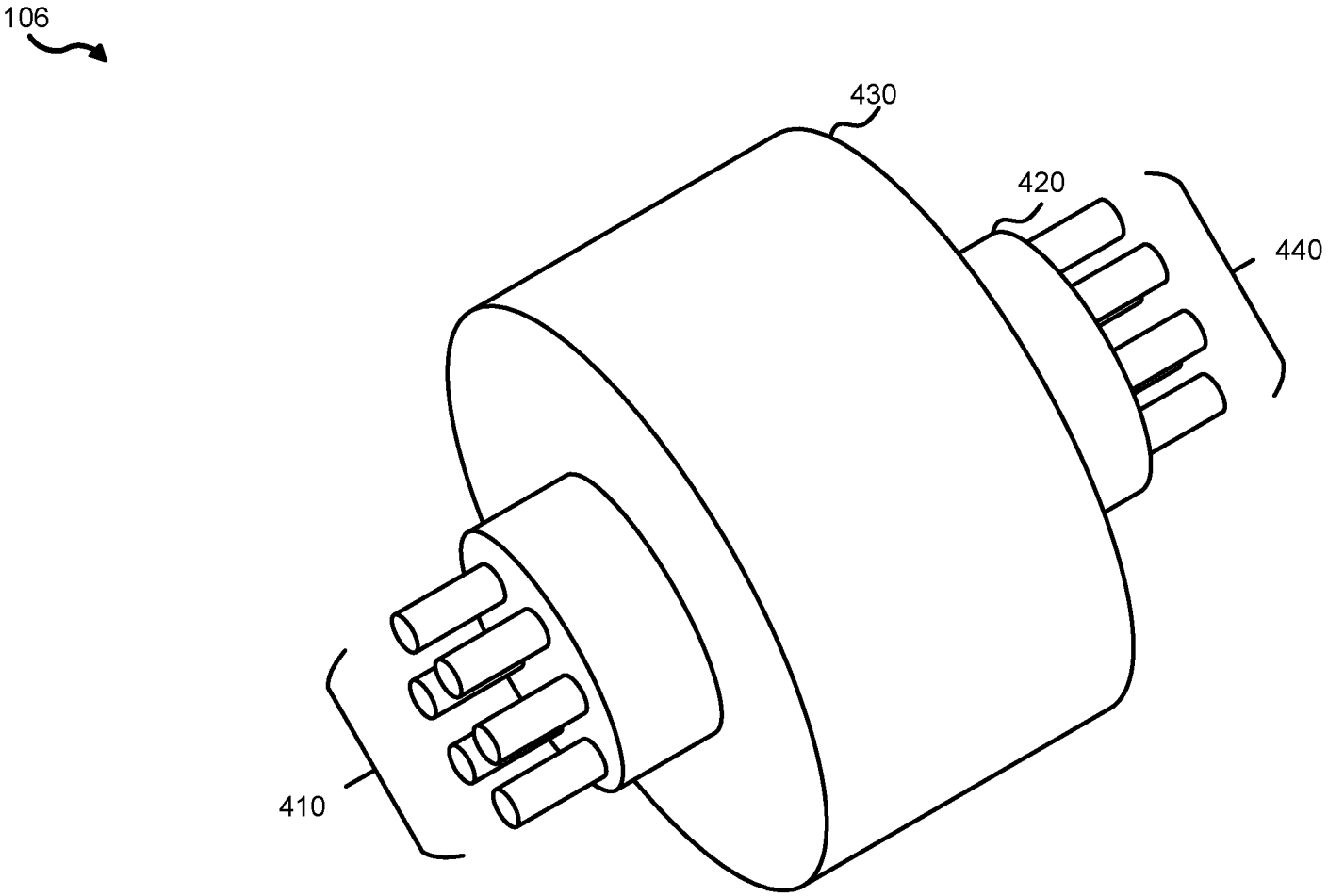
FIG. 4 illustrates a perspective view of an example of a charged particles accelerator, in accordance with aspects of the present disclosure.

Turning now to FIG. 4, a non-limiting example of the accelerator 106 of FIG. 1 is shown in a perspective view. As shown in FIG. 4, the accelerator 106 may include one or more inlets 410 for receiving one or more streams of charged particles. While FIG. 4 shows six inlets, the number of inlets may be varied based on the application, design, and/or performance of the accelerator 106, and/or availability of parts, as well as the particular application or use of the accelerator 106, for example, as may be determined by one skilled in the art.

In some implementations, the accelerator 106 may include a cavity 420, such as a TEM cavity. The cavity 420 may include an outer conductor. The cavity 420 may apply a RF electro-magnetic wave (e.g., radio wave or microwave) in TEM mode. Alternatively, the cavity 420 may apply a RF wave operating in transverse electrical (TE) mode or transverse magnetic (TM) mode. In certain examples, the cavity 420 may function as a waveguide for the applied RF wave. The applied RF wave may accelerate the one or more streams of charged particles by inputting electro-magnetic energy into the charged particles. The energy of the charged particles in the one or more beams of charged particles may increase to energy levels of 500 keV, 1 mega electron-volt (MeV), 2 MeV, 3 MeV, 5 MeV, 8 MeV, 10 MeV, 12 MeV, 15 MeV, 20 MeV, and/or 30 MeV, for example. Other energy levels are possible.

In some examples, the length of the cavity 420 may be configured such that the cavity 420 operates as a half-wave resonator (HWR) for the applied RF wave (i.e., the length of the cavity 420 is approximately one half of the wavelength of the applied RF wave). In other examples, the length of the cavity 420 may be configured such that the cavity 420 operates as a quarter-wave resonator (QWR) for the applied RF wave (i.e., the length of the cavity 420 is approximately ¼ of the wavelength of the applied RF wave). In some examples, the length of the cavity 420 may be configured to be multiples of a half of a wavelength of the applied RF wave.

In certain implementations, the accelerator 106 may include a magnet 430. The magnet may be a superconducting electro-magnet, an electro-magnet, a permanent magnet, and/or an electro-permanent magnet. The magnet 430 may be cooled to a critical temperature, or below, as needed for use and/or operation of any superconducting materials inside the magnet 430. The magnet 430 may include materials such as niobium titanium, niobium tin, vanadium gallium, magnesium diboride, bismuth strontium calcium copper oxide, yttrium barium copper oxide, and/or other suitable materials. The magnetic field strength of the magnet 430 may be 1 Tesla, 2 Tesla, 5 Tesla, 7 Tesla, 10 Tesla, or other suitable field strength. In some examples, the magnet 430 may maintain a cyclotron resonant condition in the cavity 420. The cyclotron resonance condition, as known to one skilled in the art, may cause charged particles to gyrate in a substantially circular or elliptical path and accelerate under an continuous or pulsed oscillating electric field tuned to the resonance. The electric field may add kinetic energy to the charged particles. The magnet 430 may repel or otherwise operate to maintain the one or more streams of charged particles at a minimum distance from the inner wall and/or the conductor 422 of the cavity 420. In a non-limiting example, the magnet 430 may prevent the one or more streams of charged particles from contacting an inner wall of the cavity 420 and/or the conductor.

Still referring to FIG. 4, the accelerator 106 may include one or more outlets 440. The one or more streams of charged particles may exit the cavity 420 via the one or more outlets 440. While FIG. 4 shows six outlets, the number of outlets may be varied based on the application, design, performance of the accelerator 106, and/or availability of parts, as well as the particular application or use of the accelerator 106, for example, as known by one skilled in the art.

Referring to FIGS. 1 and 4, in a non-limiting example of the cyclotron auto-resonance system 100, a 30 MHz QWR of 64 cm in diameter and 2.5 m in length may be inserted off-axially into a 4-Tesla magnet with bore size of 1.2 m in diameter and 3.4 m in length, such that the beam trajectory axis is aligned with the magnetic field axis. With 30 keV 20 mA CW deuteron injection, the final output deuteron energy may be about 3.4 MeV, while driven by a total 84 kW RF power and RF-to-Beam efficiency of 80%. Magnetic field strength ramping may be introduced to compensate the phase slippage due to slight change of deuteron energy for higher output energy.

Figure 5:
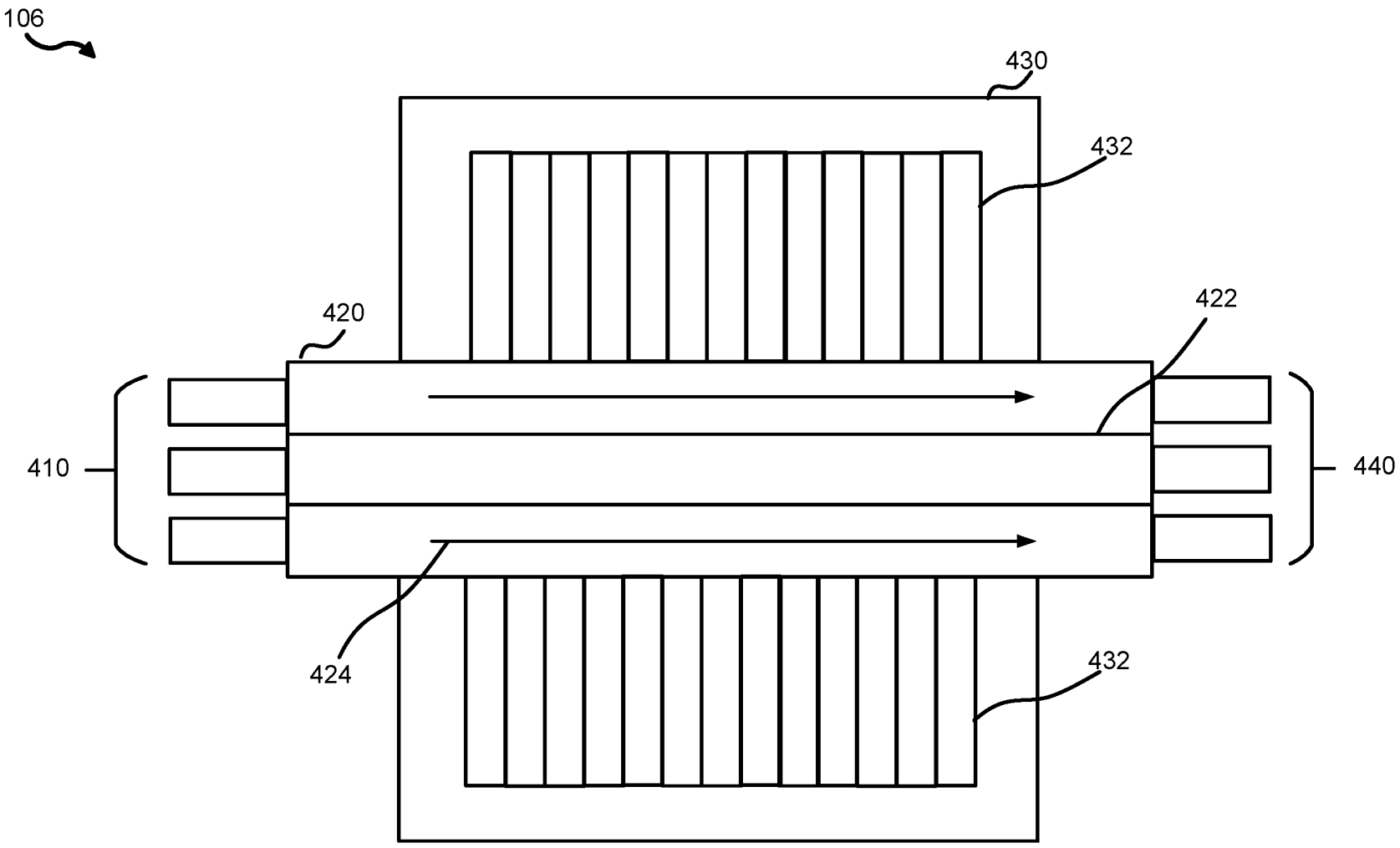
FIG. 5 illustrates a cross-sectional view of the charged particles accelerator shown in FIG. 4.

Turning now to FIG. 5, a representative cross-sectional view of the accelerator 106 of FIG. 4 illustrates magnetic coils 432 inside the magnet 430. The magnetic coils 432 may be or include wires of superconducting materials such as niobium titanium, niobium tin, vanadium gallium, magnesium diboride, bismuth strontium calcium copper oxide, yttrium barium copper oxide, and/or other suitable materials wound around or otherwise distributed within at least a portion of the cavity 420. In some examples, the magnetic coils 432 and/or other features may be cooled by coolants (e.g., liquid helium or liquid nitrogen) disposed within or about the magnet 430. The magnetic coils 432 may maintain the one or more streams of charged particles a minimum distance from an inner wall of the cavity 420.

Still referring to FIG. 5, in certain examples, the accelerator 106 may include a conductor 422 disposed within the cavity 420. At least a portion of the conductor 422 may be rod or cylindrically shaped and extend longitudinally within the cavity 420. The conductor 422 may apply a RF wave (originating from the RF power source 112) to the one or more streams of charged particles in the cavity 420. Under the application of the electro-magnetic field by the RF wave, the charged particles in the one or more streams of charged particles may move in a direction 424 away from the one or more inlets 410 toward the one or more outlets 440. Contemporaneously, the energy levels of the charged particles may increase as a result of the application of the RF wave. The energy of the charged particles in the one or more beams of charged particles may increase to energy levels of 500 keV, 1 mega electron-volt (MeV), 2 MeV, 3 MeV, 5 MeV, 8 MeV, 10 MeV, 12 MeV, 15 MeV, 20 MeV, and/or 30 MeV.

In other implementations, the conductor 422 may include one or more parallel plates, one or more rods or cylindrically shaped electrodes, and/or a combination thereof. Other configurations of the conductor 422 may also be suitable for delivering RF wave in TEM mode. In some examples, two conducting electrodes may deliver the RF wave in TEM mode.

Figure 6A:
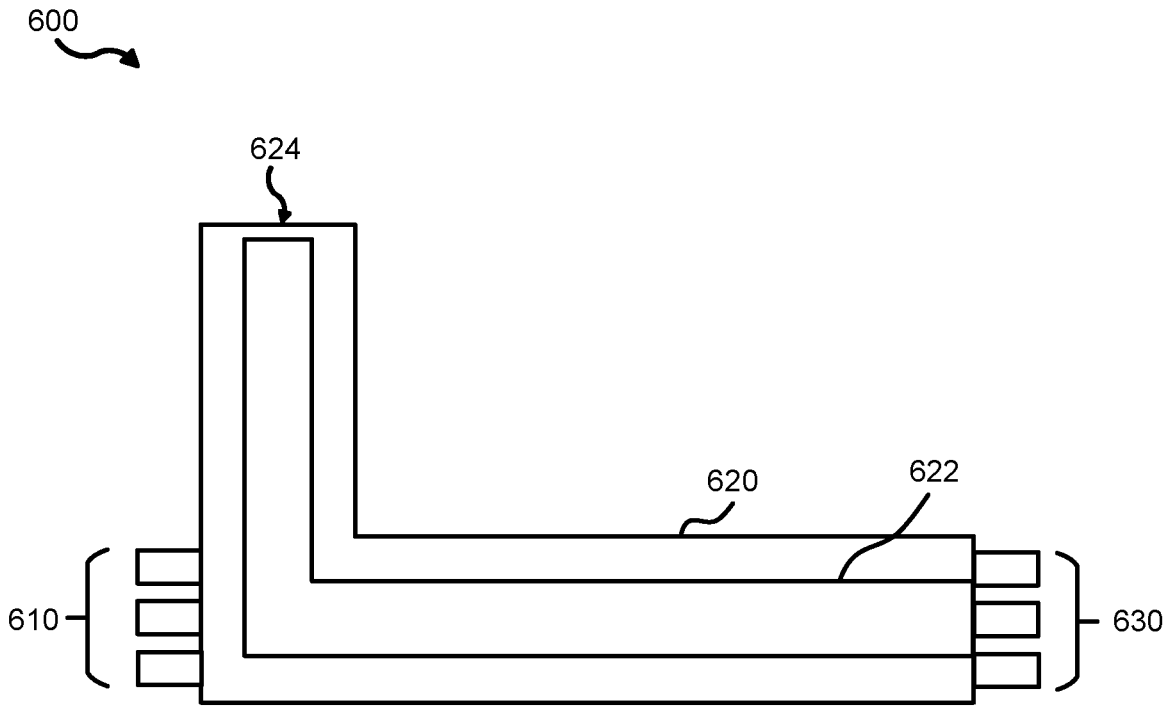
FIGS. 6A-B illustrate examples of charged particles accelerators, in accordance with aspects of the present disclosure.

Turning now to FIG. 6A, in some implementations, another example of an accelerator 600 may include one or more inlets 610, a cavity 620, a conductor 622, and one or more outlets 630. The cavity 620 and the conductor 622 may have a substantially "L" cross-sectional shape (as viewed from the side), for example, as shown in FIG. 6A. A distal end 624 of the conductor 622 may be connected to and receive power from the RF power source 112. An electro-magnet may surround the cavity 620. In some examples, the length of the cavity 620 may be configured such that the cavity 620 operates as a HWR for the applied RF wave, for example. In other examples, the length of the cavity 620 may be configured such that the cavity 620 operates as a QWR for the applied RF wave, for example.

Figure 6B:
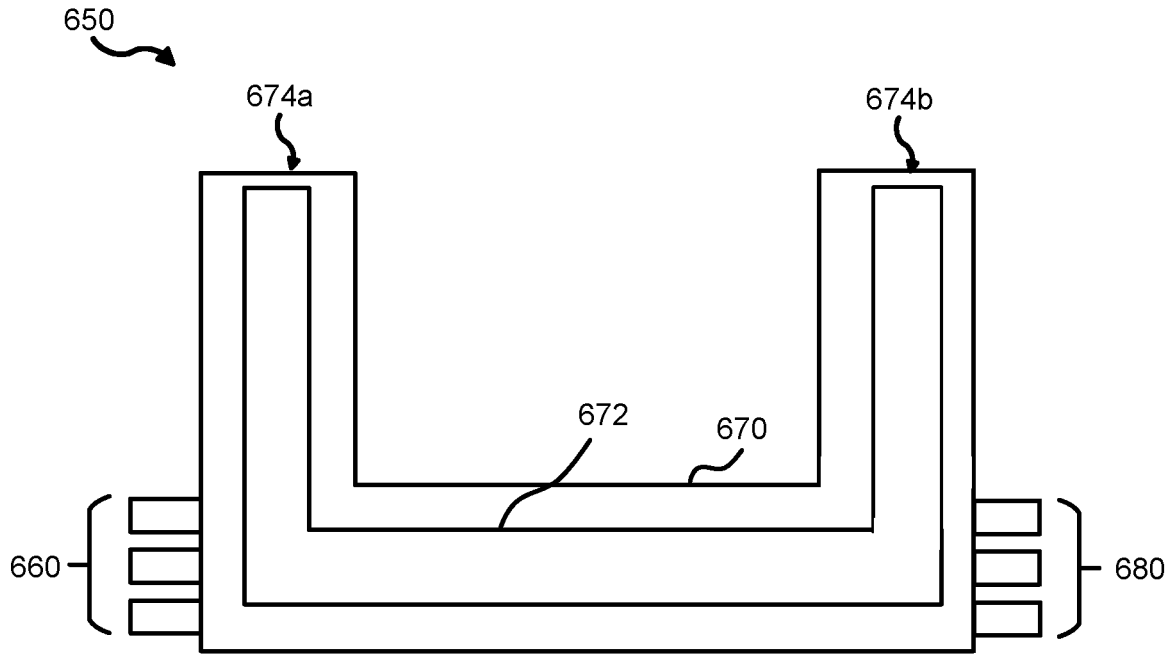

Turning now to FIG. 6B, in some implementations, another example of an accelerator 650 may include one or more inlets 660, a cavity 670, a conductor 672, and one or more outlets 680. The cavity 670 and the conductor 672 may have a substantially "U" cross-sectional shape (as viewed from the side), as shown in FIG. 6B. At least one of a distal ends 674*a*, 674*b* of the conductor 672 may be connected to and receive power from the RF power source 112. An electro-magnet may surround the cavity 670. In some examples, the length of the cavity 670 may be configured such that the cavity 670 operates as a HWR for the applied RF wave. In other examples, the length of the cavity 670 may be configured such that the cavity 670 operates as a QWR for the applied RF wave. In some example implementations, the electrical field distribution in the accelerator 650 may be approximately evenly distributed along the conductor 672.

Referring now to FIG. 1, the cyclotron auto-resonance system 100 may optionally or alternatively include the accelerator 600 of FIG. 6A or 650 of FIG. 6B to accelerate the charged particles.

Figure 7A:
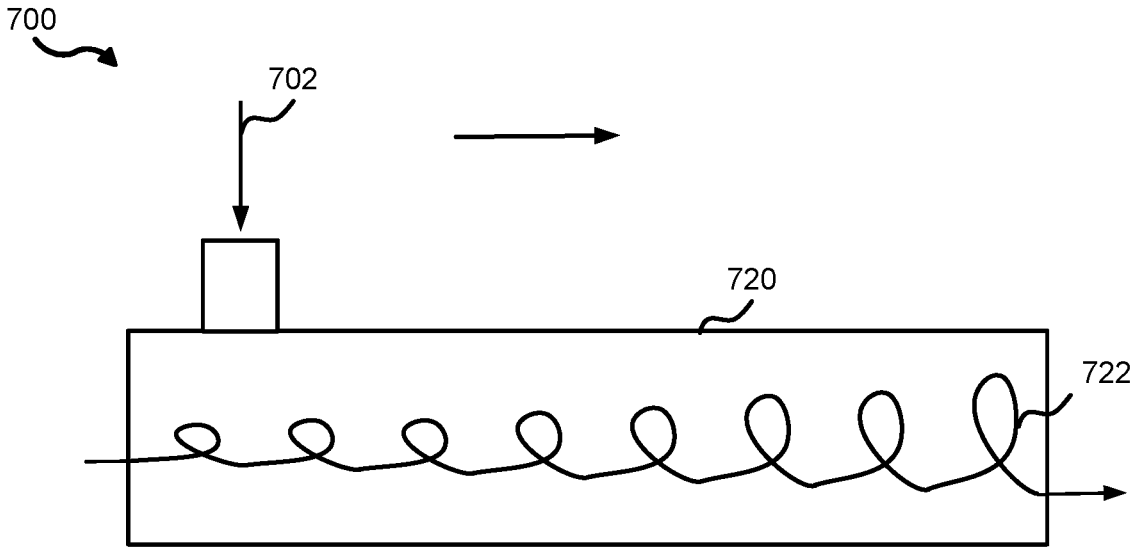
FIG. 7A illustrates an example of a beam path for accelerated charged particles in an example accelerator, in accordance with aspects of the present disclosure.

Turning now to FIG. 7A, an example accelerator 700 shown in representative view may be used to describe the physics of charged particles acceleration. In some implementations, electrical power 702 from a RF source (not shown) may be coupled to a cavity 720 operating in a TEM mode, for example. A charged particle source may inject a continuous (e.g., un-bunched) direct current (D.C.), pulsed, or bunch beam of charged particles into the cavity 720. The cavity 720 may be permeated by a profiled D.C. axial magnetic field. At resonance, defined below, continuous acceleration of a gyrating beam 722 may occur. The accelerated gyrating beam 722 may spread adiabatically in the diverging magnetic field and self-scan on a circle as it moves to and beyond the cavity 720.

Still referring to FIG. 7A, the motion and conservation of energy for a charged particle gyrating in an electromagnetic field with a fixed magnetic field may be described by the following equations:

$$mc\frac{d}{dt}\gamma\vec{v} = e(\vec{E} + \vec{v}\times\vec{B});\ mc^2\frac{d}{dt}\gamma = e\vec{v}\cdot\vec{E}$$

In a guided TEM, the transverse magnetic field is in phase with the transverse electric field $\vec{B}_\perp=\hat{z}\times\vec{E}_\perp\cdot k_z/\omega$, so the longitudinal velocity $v_z$ is related to the energy $\gamma$ by $d(\gamma v_z)/d\gamma=k_z c^2/\omega$. For TEM mode with field distribution $E_r=E_0/r$ and $B_\phi=E_0/cr$, $d\gamma/dt=-eE_0(p_x x+p_y y)\cos[\omega(t-z/c)+\phi]/(x^2+y^2)\gamma m^2c^2=1/mc\cdot dp_z/dt$, where x, y, z are Cartesian coordinates of the charged particles, and $p_{x,y,z}$ are corresponding momentums.

There may be a constant of motion $$\Gamma=\gamma(1-\Omega v_z/k_z c^2),$$

showing that the charged particle gains and loses energy and longitudinal momentum in a fully correlated manner. Continuous cyclotron resonance acceleration of the charged particles of charge e and rest mass m in the cavity 720 may occur in a guided rotating wave that satisfies the resonance condition $\omega(1-n\beta_z)=\Omega/\gamma$. Here $\omega$ is the wave's radian frequency, $n=c/v_{phase}$ is the effective refractive index for the operating mode in the RF structure, $\beta_z=v_z/c$ and $\gamma=1+W/mc^2$ are normalized axial velocity and a relativistic energy factor, respectively, for charged particles of kinetic energy W with axial velocity $v_z$, and $\Omega=eB/m$ is the rest cyclotron frequency in a static magnetic field B. When $\gamma_0-1<<1$, the maximum energy gain may be approximately by $$(\Delta E)_{max}=mc^2\sqrt{\gamma_0^2-1}$$

where $\gamma_0$ is the initial value of the relativistic energy factor, namely $1+eV/mc^2$, with V the extraction voltage of the charged particle source. In some implementations, the maximum energy gain may be proportional to the rest mass of the charged particles. In a TEM mode cavity (e.g., n=1), such as the cavity 720, with a cylindrical conductor along its center, the cavity frequency may be determined by the length of the cavity 720.

Figure 7B:
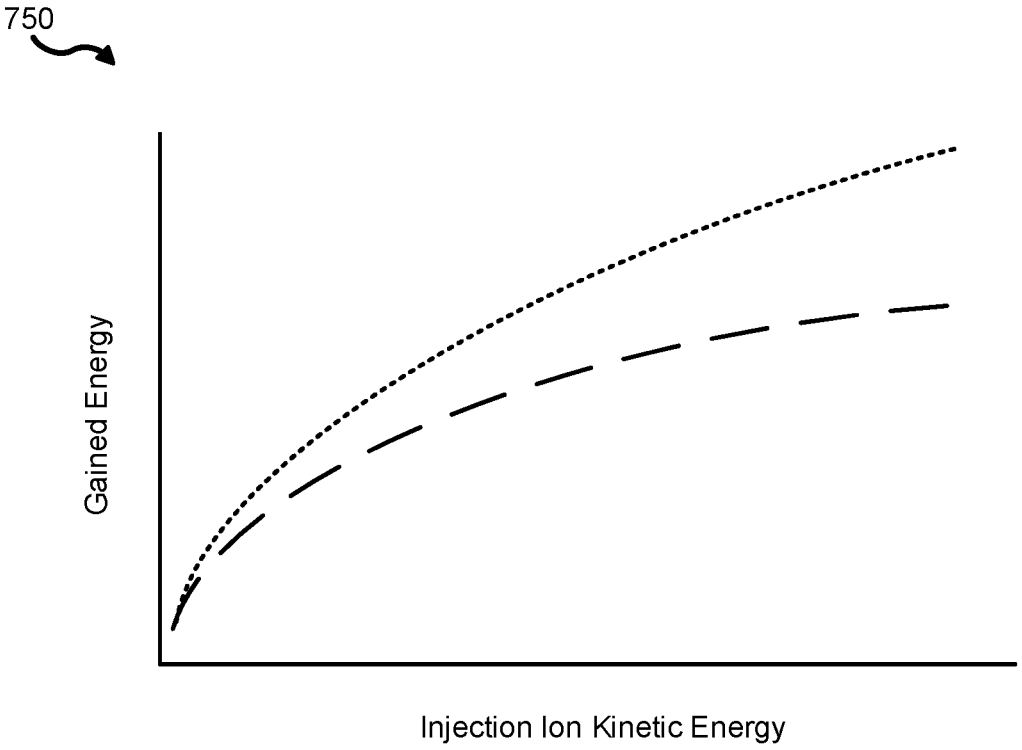
FIG. 7B illustrates an example of energy levels of charged particles accelerated by an accelerator, in accordance with aspects of the present disclosure.

Turning now to FIG. 7B, a graph 750 may illustrate examples of injection energy and gained energy for hydrogen ions (dashed line) and deuteron ions (dotted line) in the accelerator 700 of FIG. 7A. The deuteron ions may gain more energy than corresponding hydrogen ions due to higher rest mass, for example.

Figure 8:
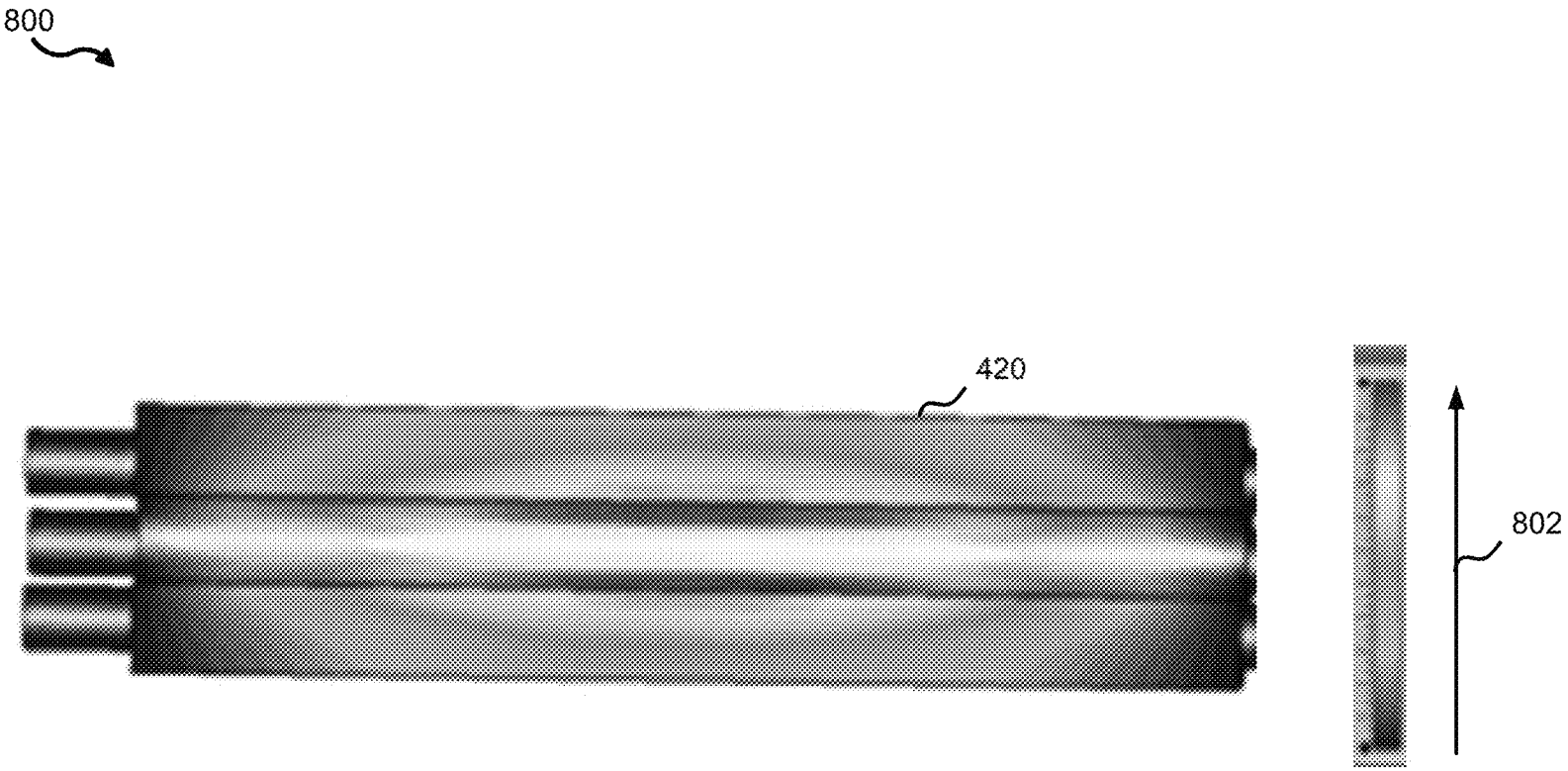
FIG. 8 illustrates an example of simulated electric field strength within an example accelerator in accordance with aspects of the present disclosure.

Turning now to FIG. 8, an example of a simulation 800 shows the electrical field distribution in the cavity 420. An arrow 802 shows relative increasing electrical field strength, from low (blue) to high (red), as shown in cavity 420. In some implementations, charged particles in the cavity 420 operating in TEM mode may experience high electrical field (e.g., 500 kV/m) around the center of the cavity 420 and low electrical field (e.g., 100 kV/m) near the ends of the cavity 420.

Turning now to FIG. 9, a table shows some examples of source particles and the corresponding product particles that may be produced by a cyclotron auto-resonance system in accordance with aspects of the present disclosure. Other source particles and product particles not listed may also be produced by a cyclotron auto-resonance system of the present disclosure. For example, in the deuteron-induced reaction with a target nucleus (here labeled "X"), e.g. $^2D+^AX\rightarrow^1p+^{A+1}X$, the neutron half of an energetic deuteron may fuse with a target nucleus, transmuting the target to a heavier isotope while ejecting a proton. Due to the low deuteron binding energy, the deuteron stripping process may overcome the nuclear Coulomb barrier.

In one example, $^8Li$ may be produced from $^7Li$ based on the following reaction: $2D+^7Li\rightarrow^1p+^8Li$. The transmuted product $^8Li$ in the nuclear reaction may go through beta-decay $^8Li\rightarrow^8Be+e^-+\bar{v}_e$, (half-life time of 839.9±9 ms, Q-value of 12.7 MeV) into $^8Be$, which may decay into two alpha particles with a half-life of $6.7\times10^{-17}$ s. A by-product in the beta-decay of $^8Li$ may be the electron antineutrino $\bar{v}_e$ with average energy that is close to that of nuclear reactor neutrinos.

In other examples, several medical isotopes used in Positron Emission Tomography (PET) such as $^{11}C$, $^{13}N$ and $^{18}F$, and isotopes used in Single-Photon Emission Computed Tomography (SPECT) such as $^{67}Ga$, $^{123}I$ and $^{99m}Tc$ may also be produced in deuteron-induced reactions with deuteron energy between 2 and 2.5 MeV, for example. SPECT isotope $^{99m}Tc$ as Auger electron emitters with radioactive emissions of high linear energy transfer (LET) may be of interests for the radiotherapy application. $^{99m}Tc$ may be produced using the deuteron reaction $^{98}Mo$ (d, n)$^{99m}Tc$ and $^{100}Mo$ (d, 3n) $^{99m}Tc$.

In another example implementation, the cyclotron auto-resonance system 100 may produce radionuclides capable of functioning as diagnostic/therapeutic ("theranostic") pairs or single isotopes combining both traits, including $^{64}Cu/^{67}Cu$, $^{44}Sc/^{47}Sc$, or Re for medical application. The $^{44}Sc/^{47}Sc$ theranostic pair may be produced using deuteron induced reactions with Ti, e.g., $^{46}$Ti (d, α) $^{44}$Sc, $^{47}$Ti (d, n+α) $^{44}$Sc, $^{47}$Ti (n, p) $^{47}$Sc, $^{47}$Ti (d, 2p) $^{47}$Sc.

Figure 10:
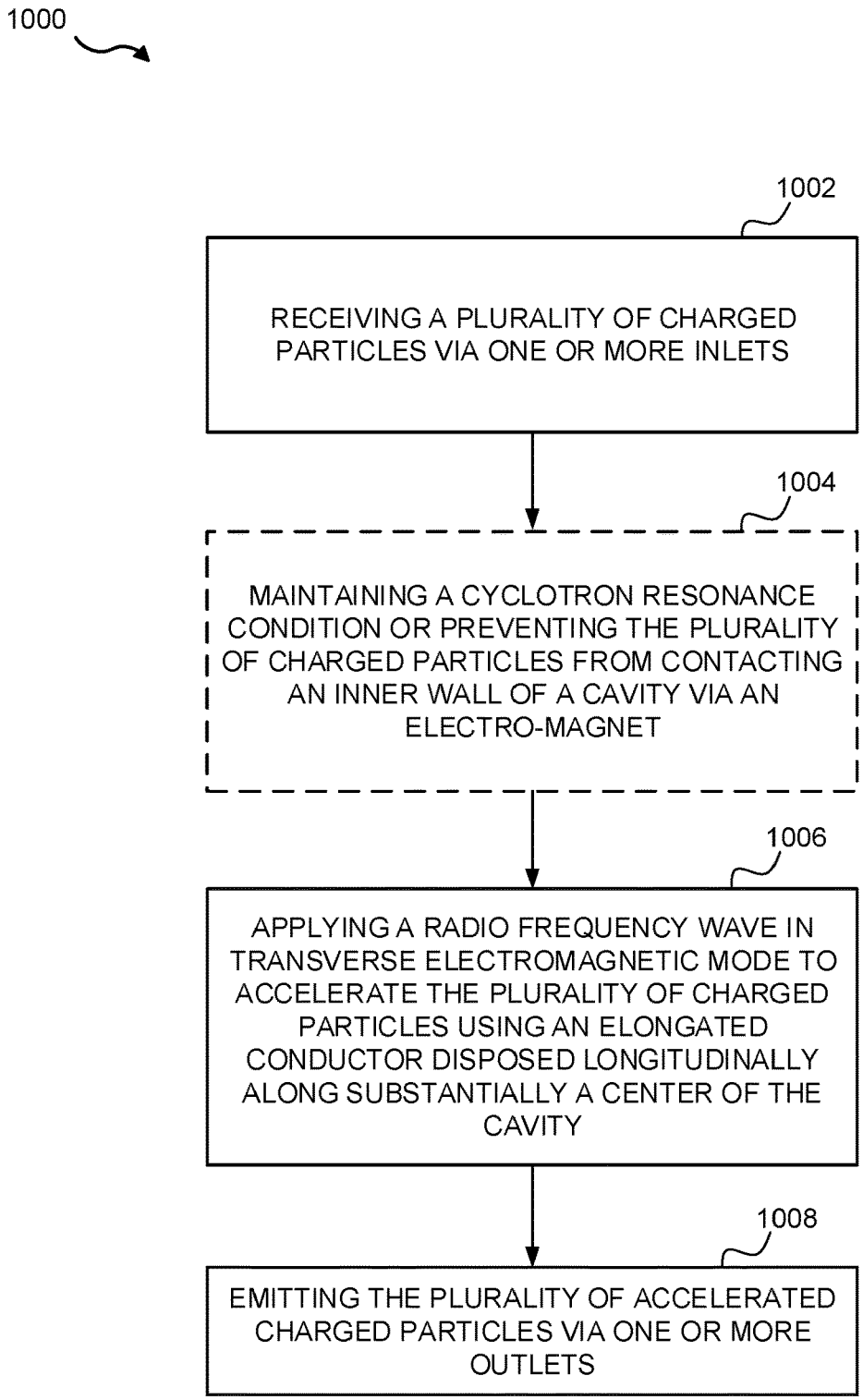
FIG. 10 illustrates a flow chart of an example of a method for accelerating charged particles, in accordance with aspects of the present disclosure.

Turning now to FIG. 10, a flowchart of an example method 1000 for accelerating charged particles may be performed by the cyclotron auto-resonance system 100 of FIG. 1, for example.

At 1002, the method 1000 may include receiving a plurality of charged particles via one or more inlets. For example, the cavity 420 of the accelerator 106 (FIG. 5), the cavity 620 of the accelerator 600 (FIG. 6A), or the cavity 670 of the accelerator 650 (FIG. 6B) may receive a plurality of charged particles via one or more inlets (e.g., 6 inlets).

At 1004, the method 1000 may optionally include maintaining a cyclotron resonance condition and/or preventing the plurality charged particles from contacting an inner wall of a cavity via an electro-magnet. For example, the magnet 430 of the accelerator 106 in FIG. 5 may maintain a cyclotron resonance condition and/or preventing the plurality of charged particles from contacting an inner wall of the cavity 420.

At 1006, the method 1000 may include applying a radio frequency wave in transverse electromagnetic mode to accelerate the plurality of charged particles using an elongated conductor disposed longitudinally along substantially a center of the cavity. For example, the conductor 422 in the cavity 420 (FIG. 5), the conductor 622 in the cavity 620 (FIG. 6A), or the conductor 672 in the cavity 670 (FIG. 6B) may apply a radio frequency wave in transverse electromagnetic mode to accelerate the plurality of charged particles.

At 1008, the method 1000 may include emitting the plurality of accelerated charged particles via one or more outlets. For example, the cavity 420 of the accelerator 106 (FIG. 5), the cavity 620 of the accelerator 600 (FIG. 6A), or the cavity 670 of the accelerator 650 (FIG. 6B) may emit the plurality of accelerated charged particles via one or more outlets.

In some implementations, one or more of the accelerators 106 (FIG. 5), 600 (FIG. 6A), 650 (FIG. 6B) may provide means for accelerating charged particles, including one of the cavities 420 (FIG. 5), 620 (FIG. 6A), 670 (FIG. 6B), and/or the conductor 422 in the cavity 420 (FIG. 5), the conductor 622 in the cavity 620 (FIG. 6A), or the conductor 672 in the cavity 670 (FIG. 6B), as described above.

While the aspects described herein have been described in conjunction with the example aspects outlined above, various alternatives, modifications, variations, improvements, and/or substantial equivalents, whether known or that are or may be presently unforeseen, may become apparent to those having at least ordinary skill in the art. Accordingly, the example aspects, as set forth above, are intended to be illustrative, not limiting. Various changes may be made without departing from the spirit and scope of the disclosure. Therefore, the disclosure is intended to embrace all known or later-developed alternatives, modifications, variations, improvements, and/or substantial equivalents.

Also, it will be appreciated that various implementations of the above-disclosed and other features and functions, or alternatives or varieties thereof, may be desirably combined into many other different systems or applications. Also that various presently unforeseen or unanticipated alternatives, modifications, variations, or improvements therein may be subsequently made by those skilled in the art which are also intended to be encompassed by the following claims.

What is claimed is:

1. A device, comprising:

a charged particle source configured to provide charged particles;

an accelerator including:

a cavity having one or more inlets and one or more outlets;

an electro-magnet substantially surrounding at least a portion of the cavity;

a conductor disposed longitudinally within the cavity, the conductor being configured to accelerate the charged particles entering the cavity through the one or more inlets via a radio frequency wave applied to the conductor, wherein the radio frequency wave operates in transverse electromagnetic mode; and a target configured to receive the accelerated charged particles via the one or more outlets.

2. The device of claim 1, wherein the target includes a high density supersonic helium jet gas target, a liquid/solid lithium target, a solid target, a cylindrical target, a spherical target, a copper target, a scandium target, or a rhenium target.

3. The device of claim 1, further comprising:

a low energy beam transport configured to guide the charged particles from the charged particle source into the cavity of the accelerator; and a medium energy beam transport configured to guide the accelerated charged particles from the accelerator toward the target.

4. The device of claim 1, further comprising:

a radio frequency power supply that applies a continuous or pulsed radio frequency wave to the cavity.

5. The device of claim 1, wherein an energy level of the accelerated charged particles is at least 50 keV.

6. The device of claim 1, wherein the cavity has a substantially "L" cross-sectional shape or a substantially "U" cross-sectional shape.

7. The device of claim 1, wherein the electro-magnet is a superconducting electro-magnet configured to perform at least one of maintaining a cyclotron resonance condition or preventing the charged particles from contacting an inner wall of the cavity of the accelerator.

8. A particle accelerator, comprising:

a transverse electromagnetic mode (TEM) cavity;

a plurality of inlets configured to receive one or more streams of charged particles into the TEM cavity;

a superconducting electro-magnet encapsulating at least a portion of the TEM cavity, wherein the electro-magnet is configured to perform at least one of maintaining a cyclotron resonance condition or preventing the one or more streams of charged particles from contacting an inner wall of the TEM cavity; and a rod-shape conductor disposed longitudinally within the TEM cavity configured to accelerate the one or more streams of charged particles into one or more streams of accelerated charged particles by applying electromagnetic radiations in TEM mode.

9. The particle accelerator of claim 8, wherein the superconducting electro-magnet includes magnetic coils having niobium titanium, niobium tin, vanadium gallium, magnesium diboride, bismuth strontium calcium copper oxide, or yttrium barium copper oxide.

10. The particle accelerator of claim 8, wherein the electromagnetic radiations in TEM mode is a continuous or pulsed radio frequency radiation to the cavity.

11. The particle accelerator of claim 10, wherein the continuous or pulsed radio frequency wave has a frequency of at least 10 megahertz (MHz).

12. The particle accelerator of claim 10, wherein the TEM cavity is a half-wave resonator or a quarter-wave resonator for the continuous or pulsed radio frequency wave.

13. The particle accelerator of claim 8, wherein the TEM cavity has substantially a cylindrical cross section and a substantially "L" cross-sectional shape or a substantially "U" cross-sectional shape.

14. The particle accelerator of claim 8, wherein an energy level of the accelerated charged particles in the one or more streams of accelerated charged particles is at least 50 keV.

15. A method, comprising:

receiving a plurality of charged particles via one or more inlets;

applying a radio frequency wave in transverse electromagnetic mode to accelerate the plurality of charged particles using an elongated conductor disposed longitudinally along substantially a center of a cavity; and emitting the plurality of accelerated charged particles via one or more outlets.

16. The method of claim 15, further comprising:

prior to receiving the plurality of charged particles, accelerating the plurality of charged particles to an energy level ranging from 10 kilo electron-volts to 100 kilo electron-volts.

17. The method of claim 15, further comprising:

focusing the plurality of accelerated charged particles onto a concentrated area on a target.

18. The method of claim 15, wherein the cavity comprises:

a half-wave resonator or a quarter-wave resonator for the radio frequency wave;

a substantially cylindrical cross sectional shape; and a substantially "L" cross-sectional shape or a substantially "U" cross-sectional shape.

19. The method of claim 15, wherein the radio frequency wave is a continuous or pulsed radio frequency wave to the cavity.

20. The method of claim 19, wherein the continuous or pulsed radio frequency wave has a frequency of at least 10 MHz.

* * * * *